US007000711B2

(12) United States Patent
Miller et al.

(10) Patent No.: US 7,000,711 B2
(45) Date of Patent: Feb. 21, 2006

(54) HORIZONTAL BORE CRYOGENIC DRILLING METHOD

(75) Inventors: Thomas J. Miller, Shrewsbury, MO (US); John R. Jansen, West Bend, WI (US)

(73) Assignees: CH2M Hill, Inc., Englewood, CO (US); Ruekert & Meilke, Inc., Waukesha, WI (US)

( * ) Notice: Subject to any disclaimer, the term of this patent is extended or adjusted under 35 U.S.C. 154(b) by 157 days.

(21) Appl. No.: 10/774,678

(22) Filed: Feb. 9, 2004

(65) Prior Publication Data

US 2005/0173156 A1 Aug. 11, 2005

(51) Int. Cl.
*E21B 7/00* (2006.01)
*E21B 7/08* (2006.01)

(52) U.S. Cl. ..... 175/65; 175/18; 166/50

(58) Field of Classification Search ..... 175/18, 175/65, 62; 166/50, 313, 117.6
See application file for complete search history.

(56) References Cited

U.S. PATENT DOCUMENTS

| | | | |
|---|---|---|---|
| 1,906,771 | A | 5/1933 | Sandstone |
| 2,193,219 | A | 3/1940 | Bowie |
| 2,621,022 | A | 12/1952 | Bardill |
| 2,812,160 | A | 11/1957 | West |
| 2,905,444 | A | 9/1959 | Shepard |
| 2,915,285 | A | 12/1959 | Deily |
| 3,223,186 | A | 12/1965 | Lummus |
| 3,422,892 | A | 1/1969 | Bryant, Jr. |
| 3,424,254 | A | 1/1969 | Huff |
| 3,612,192 | A | 10/1971 | Maguire, Jr. |
| 3,650,337 | A | 3/1972 | Andrews |

(Continued)

OTHER PUBLICATIONS

Cavagnaro, et al., "A Successful Borehole drilled by Cryogenic Drilling in an Arid Unconsolidated Soil with Boulders" submitted for Presentation at the Energy Week Conference and Exhibit on Jan. 28-30, 1997.

(Continued)

*Primary Examiner*—Frank S. Tsay
(74) *Attorney, Agent, or Firm*—Swanson & Bratschun LLC

(57) ABSTRACT

A horizontal bore cryogenic drilling method includes in a first embodiment forming a pilot hole of a first select diameter along a desired path of the horizontal bore. A grindable casing is inserted into the guide bore. A cryogenic fluid is flowed through the grindable casing to form a freeze zone of frozen moisture adjacent the grindable casing having a second select diameter. A primary bore is formed having a third select diameter greater than the first diameter and less than the second select diameter within the freeze zone along the desired path of the horizontal bore with the grindable casing in place. The second diameter is selected to be sufficiently greater than the third select diameter to prevent collapse of the freeze zone. Another embodiment of the invention is a method of forming a horizontal bore in an earth formation including providing a drill string having a conduit communicating with a cutting tool for engaging the earth formation. A cryogenic fluid is flowed through the conduit and the cutting tool to drive the cutting tool and remove cuttings from a bore formed by the cutting tool. The cutting tool is directed into an earth formation and a freeze zone is formed in the earth formation in advance of the cutting tool by the cryogenic fluid flowing through the cutting tool. The cutting tool is then advanced into the earth formation to form the horizontal bore at a rate enabling continuous formation of a freeze zone in advance of the cutting tool of sufficient diameter to prevent collapse of the bore as the cutting tool is advanced.

16 Claims, 8 Drawing Sheets

U.S. PATENT DOCUMENTS

| | | | |
|---|---|---|---|
| 3,720,065 | A | 3/1973 | Sherard |
| 3,774,701 | A | 11/1973 | Weaver |
| 4,191,266 | A | 3/1980 | van Eek |
| 4,287,957 | A | 9/1981 | Evans |
| 4,516,878 | A | 5/1985 | Rebhan |
| 4,997,047 | A | 3/1991 | Schroeder |
| 5,388,650 | A | 2/1995 | Michael |
| 5,701,963 | A | 12/1997 | McCormick |
| 5,715,895 | A | 2/1998 | Champness |
| 6,782,947 | B1 | 8/2004 | de Rouffignac |

OTHER PUBLICATIONS

Cooper & Simon, "Filed Test of the Cryogenic Method for Environmental Well Installation" presented at the 1995 ASME Energy-Sources Technology Conference and Exhibition, Houston, Texas, Jan. 29-Feb. 1, 1995.

Innovative Technology Summary Report, "Cryogenic Drilling, Subsurface Contaminants Focus Area," prepared for U.S. Department of Energy office of Environmental Management Office of Science and Technology, Oct. 1998.

Simon & Cooper, "Use of Cryogenic Fluids for Environmental Drilling in Unconsolidated Formations" published in ASME (American Society of Mechanical Engineering) Energy Sources Technology Conference and Exhibition, New Orleans, Louisiana, Jan. 23-26, 1994.

Simon & Cooper, "Cryogenic Drilling: A New Method for Environmetnal Remediation" published in Ground Water Monitoring and Remediation, 1996, p. 79-85.

Vermeer website at www.vermeer.com/equipment/directional_boring/ (printed Dec. 5, 2003).

HORIZONTAL BORE CRYOGENIC DRILLING METHOD

TECHNICAL FIELD

The present invention is directed toward drilling bores in earth formations, and more particularly to a horizontal bore cryogenic drilling method.

BACKGROUND ART

In many aquifers, the ability to produce water by traditional vertical wells is limited by several factors. In the case of thin aquifers, vertical wells do not allow a long enough section of screen to be installed across the productive formation. This limits the area of the seepage base that can transmit water into the well and reduces the amount of available drawdown that can be created to induce flow toward the well. Both of these factors prevent vertical wells from producing as much water as could be potentially extracted. In other cases, the most productive portion of the aquifer is located under a physical obstruction where a vertical well cannot be installed. These obstructions typically include rivers, lakes, wetlands, structures or other areas where a wellhead is not permitted or access for a vertical drilling rig is impractical.

Horizontal wells are often constructed near or under sources of groundwater recharge, such as rivers, lakes or wetlands. As used herein, "horizontal" well or bore means a well or bore that is not exclusively vertical, but has a substantially horizontal or sub-horizontal portion substantially parallel to the ground surface that allows the horizontal bore to access aquifers of limited depth or to access aquifers blocked from vertical access by obstructions as discussed above. Installing a screen under a source of recharge has the effect of inducing additional recharge to the aquifer. This can substantially increase the sustained yield of a horizontal well by capturing surface water.

Horizontal water supply wells have been traditionally constructed using radial horizontal collector wells, also known as Ranney® type wells. Radial horizontal collector wells are constructed with large vertical caissons, several feet to tens of feet in diameter, installed to the depth of interest. Well screens or casings are jacked or otherwise advanced horizontally from the caisson to the geologic formation. The well screens or casings form horizontal laterals that conduct water from the formation into the caisson where it is pumped to the surface. Building a radial horizontal collector well using this conventional construction technique is a difficult and lengthy undertaking. For this reason, radial horizontal collector wells are often several times the cost of a traditional vertical well. In addition, the laterals cannot generally be steered or directed other than by simple linear protection from the caisson. The method has limited ability to project laterals through boulders, cobbles or other obstruction or difficult drilling conditions.

An additional problem with this conventional construction technique is fluid invasion into the open face of the lateral cannot be controlled during construction. This creates a need to pump significant volumes of water to keep the caissons from flooding during construction. The lateral jacking process usually requires workers to be at the bottom of the caisson. This forces workers to endure wet conditions in a confined space below the water table with all the inherent risks and safety hazards that can occur under such conditions.

Horizontal directional drilling has been used to install utilities such as pipelines and cables, to extract geologic samples, and for various other purposes. These methods involve mud rotary drilling in which the bit enters the ground from a trench or shallow angle from the surface. The bit is directed horizontally as it is pushed from the surface via the drill string. In some recent manifestations, the drill bit can be steered down hole using several cutting heads on a down hole drilling motor. The bit can be steered to direct the bore hole vertically or horizontally. Directionally drilled horizontal holes can be drilled to a point of underground termination. The bit and drill string may then be removed and the well is completed from the opening of the bore hole at the surface. This type of horizontal hole is called a blind hole as the end of the hole is never seen. Horizontal bore holes can also be steered to the surface and terminated above ground. These two sided completions are commonly called continuous bores and allow materials to be introduced into the hole from either side in order to complete construction of, for example, a water supply well.

One known maker of horizontal directional drills is Vermeer Manufacturing Company of Pella, Iowa. Examples of their horizontal directional drills can be seen on their website.

All known existing horizontal directionally drilled bore holes use drilling mud to keep the hole from collapsing, prevent the invasion of large volumes of formation water, remove the cuttings from the bore hole as the drill string advances and provide power and cooling for the down hole drilling motor. The drill muds fall into two major categories, muds based on inorganic clay minerals, such as bentonite, or organic polymers known as biosolid muds. While the use of drilling mud is necessary for the construction of the bore hole, either type of mud produces undesirable effects on the formation around the bore hole. The drilling mud is kept under positive hydraulic head in the bore hole to keep the formation from collapsing. The hydraulic head causes the mud to exfiltrate from the bore hole into the adjacent formation. As it penetrates the formation, the mud creates a zone of invasion which reduces the permeability of the formation adjacent to the bore hole. This has the desirable effect of reducing infiltration of formation water into the bore hole during well construction, but also creates a zone of low permeability that limits the ability of water to flow into the bore hole after construction is completed.

Horizontally directionally drilled bore holes are most commonly used to install cables and pipelines. In these applications, mud invasion of the formation is not a significant concern. However, recently horizontally directionally drilled bore holes have been used to install well screens for environmental remediation wells and for high capacity water supply wells. In these applications, the zone of low permeability created by mud invasion significantly reduces the production capacity of the well. To date, efforts to remove the drilling mud from the invaded zone have proven to be expensive and of only limited effectiveness.

Additional limitations of horizontal directionally drilled borings using drilling muds are commonly encountered. The method has limited ability to prevent collapse of the bore hole in formations containing cobbles and loose gravel. This can cause the formation to collapse on the drilling string. In addition, there is a tendency for cuttings to settle out of the mud forming an obstruction on the bottom of the horizontal portion of the hole. This can also trap the drill string in the hole. Finally, a curved radius of the bore hole is used as a fulcrum to bend the drill string from sub-horizontal to horizontal. In many applications, the formations lack the structural integrity to withstand the stress as the drill rod is forced into the formation at the top of the bore hole. This results in an irregularly shaped bore hole known as a key seat. Key seats can trap the bit in the hole for blind well installations. As a result, grouted casings must be installed across the curved radius of the sub-horizontal portion of the bore hole for longer blind well completions or when dealing with soft formations. This increases the cost and complexity of the drilling operation.

In the drilling of vertical wells, problems of contamination of the area adjacent the well bore by drilling muds has been recognized. Also, where vertical wells have been drilled in earth formations having a high water content, problems have been experienced in extracting water fast enough to effectively advance the drill. In addition, particularly in places where certain shales swell or hydrate in the presence of an influx of water into the well bore, problems have been encountered with the shale becoming loosened and sloughing into the hole necessitating large quantities of shale and cuttings to be lifted out of the well bore. Indeed, if enough shale is loosened, the drill string may even become stuck.

One solution to these problems that has been proposed is using cryogenic gas or liquids as a drilling mud to form a frozen boundary around the vertical bore as it is drilled. Vertical cryogenic drilling methods are described in Maguire, U.S. Pat. No. 3,612,192 and Weaver, U.S. Pat. No. 3,774,701. However, there is no suggestion in these references of the desirability of using vertical cryogenic well drilling techniques for the construction of horizontal bores.

Rebhan, U.S. Pat. No. 4,516,876, describes a tunnel construction technique wherein a pair of vertical caissons are installed at opposite ends of a horizontal tunnel segment. A pilot hole is then drilled between the caissons. A freezing pipe is inserted into the hole and a cooling agent is supplied to the hole to freeze soil adjacent the freeze pipe. Upon creating a freeze zone of sufficient diameter a rotary excavating device rotates around the freezer work pipe to excavate the tunnel. Upon completing excavation of the lengthwise segment of the tunnel, the freezer work pipe is advanced to create a further length of freeze zone and casings can be installed in the newly excavated tunnel. The technique of Rebhan does not allow for construction of cryogenic horizontal wells from the ground surface, nor does it allow the use of directionally controlled drilling equipment.

The present invention is directed toward overcoming one or more of the problems discussed above.

SUMMARY OF THE INVENTION

A first aspect of the invention is a method of forming a horizontal bore in an earth formation. A pilot hole is formed of a first select diameter along a desired path of the horizontal bore. A grindable casing, preferably a high-density polyethylene casing, is inserted into the pilot hole. A cryogenic fluid is flowed through the grindable casing to form a freeze zone of frozen moisture adjacent to the grindable casing having a second selected diameter. A primary bore is formed having a third select diameter greater than the first select diameter and less than the second select diameter within the freeze zone along the desired path of the horizontal bore with the grindable casing in place. The second diameter is selected to be sufficiently greater than the third select diameter to prevent collapse of the freeze zone.

Forming of the pilot hole is preferably accomplished using a directionally controlled drill string driven by a cryogenic fluid or conventional drilling mud. Preferably, the bore is constructed from a ground surface overlying the earth formation and the horizontal bore includes a transverse portion transverse the ground surface and a horizontal portion substantially parallel to the ground surface. Preferably, for a water well completion, a screen or screen and gravel pack is installed in the horizontal portion of the primary bore while the freeze zone remains sufficiently frozen to prevent collapse of the primary bore. A casing is installed between the ground surface and the screen. A submersible pump may be installed in either the transverse portion or the horizontal portion. Alternatively, a vertical shaft may be provided between the ground surface and the horizontal portion of the bore and a pump may be provided proximate an intersection between the vertical shaft and the horizontal portion of the bore. In a highly preferred embodiment, the second select diameter defines a freeze zone of sufficient structural integrity to withstand mechanical forces of a directional drill string used in forming the primary bore as the primary bore transitions from the transverse portion to the horizontal portion without collapse of the primary bore.

A second aspect of the present invention is a method of forming a horizontal bore in an earth formation which includes providing a drill string having a conduit communicating with a cutting tool for engaging the earth formation. A cryogenic fluid is flowed through the conduit and the cutting tool to drive the cutting tool and remove cuttings from a bore formed by the cutting tool. The cutting tool is directed into an earth formation and a freeze zone is formed in the earth formation in advance of the cutting tool by the cryogenic fluid flowing through the cutting tool. The cutting tool is then advanced into the earth formation to form the horizontal bore at a rate enabling continued formation of a freeze zone in advance of the cutting tool of sufficient diameter to prevent collapse of the bore as the cutting tool is advanced.

The method may further include initially directing the cutting tool into the earth formation at a ground surface above the formation and advancing the cutting tool to form a transverse portion of the horizontal bore transverse to the ground surface and a horizontal portion of the horizontal bore substantially parallel to the ground surface. The freeze zone is preferably formed to have a large enough diameter that it has sufficient structural integrity to withstand mechanical forces of the drill string as the bore transitions from the transverse portion to the horizontal portion without collapse of the bore. The method may further include installing a well screen or well screen and gravel pack within the horizontal portion of the bore while the freeze zone remains sufficiently frozen to prevent collapse of the horizontal portion of the bore. A casing is installed to connect the screen to the surface. A submersible pump may be installed in one of the transverse portion or the horizontal portion of the well bore. Alternatively, a vertical shaft may be provided between the ground surface and the horizontal portion of the bore. A vertical line shaft or submersible pump is then provided proximate to an intersection between the vertical shaft and the horizontal portion of the bore.

The horizontal bore cryogenic drilling method in accordance with the present invention eliminate the need to use conventional drilling muds which can both pollute the earth formations around a well screen and plug the formation to prevent the efficient flow of water into a horizontal well bore. The cryogenic fluid further allows freezing of formation around the bore hole which allows the earth formation to take on the character of hard rock. This not only improves the structural integrity in the vicinity of the bore, but it eliminates infiltration of formation fluid and eliminates exfiltration of drilling fluids. The cryogenic technique further provides a solid formation which enables the use of drilling hammers as an alternative to rotary drills which can speed construction of the bore. In addition, the frozen cuttings act like dry powdered rock, which can be more efficiently removed from a bore by a cryogenic drilling fluid. The technique also eliminates the need to install grouted casings across the radius of the bore hole where it transfers from transverse to horizontal, thus further speeding and simplifying construction of the bore. In addition, the cryogenic technique renders irrelevant encountering cohesive soils such as clay which might otherwise form problematic clay balls. Finally, physical changes to the formation around the bore hole created by the cryogenic method are temporary. The formation will revert to its natural conditions shortly after circulation of the cryogenic fluid is stopped. By way of contrast, mud rotary methods require elaborate well development processes to remove the mud invasion from the formation and these processes have proven unsatisfactory.

DETAILED DESCRIPTION OF THE PREFERRED EMBODIMENT

The present is invention contemplates the use of standard horizontal directional drilling equipment with only minor modifications to accommodate the cryogenic fluid. One representative manufacturer of horizontal directional drills is the Vermeer Manufacturing Company of Pella, Iowa. These horizontal directional drills allow the formation of bores having an initial portion transverse a surface of the earth which then transitions to a horizontal portion of a horizontal bore.

As mentioned above, use of cryogenic fluids may require modifications to standard horizontal directional rigs. For example, it will likely be necessary to provide a substitute material for low carbon steel used in conventional drill strings because the low carbon steel may become too brittle at cryogenic temperatures. For vertical drill strings, use of aluminum drill pipe or steel pipe containing 9% or more nickel has been suggested. Weaver, U.S. Pat. No. 3,774,701, at column 2, line 68–73. Use of cryogenics may also require modification of conductor pipe, casing head, bits, rotary hose and circulating head gaskets used in conventional flow horizontal drilling systems.

As used herein, cryogenic fluid means chilled gas, liquefied gasses or cryogenic brine solutions. Representative chilled gasses may include nitrogen, natural gas, carbon dioxide, methane, propane, neon and the like. Liquefied gases may include liquefied nitrogen, propane, carbon dioxide, methane, natural gas and the like. Obviously, modifications to conventional horizontal directional drill equipment will be a function of a particular cryogenic fluid selected.

Weaver, U.S. Pat. No. 3,774,701, the contents of which are expressly incorporated herein by reference, discloses use of compressed air as a cryogenic gas, steps to remove moisture from the air and modification of a vertical drill bit for use with chilled compressed air. Maguire, U.S. Pat. No. 3,612,192, which is also expressly incorporated by reference herein, similarly teaches a vertical cryogenic drill system using chilled gas such as air.

Figure 1:
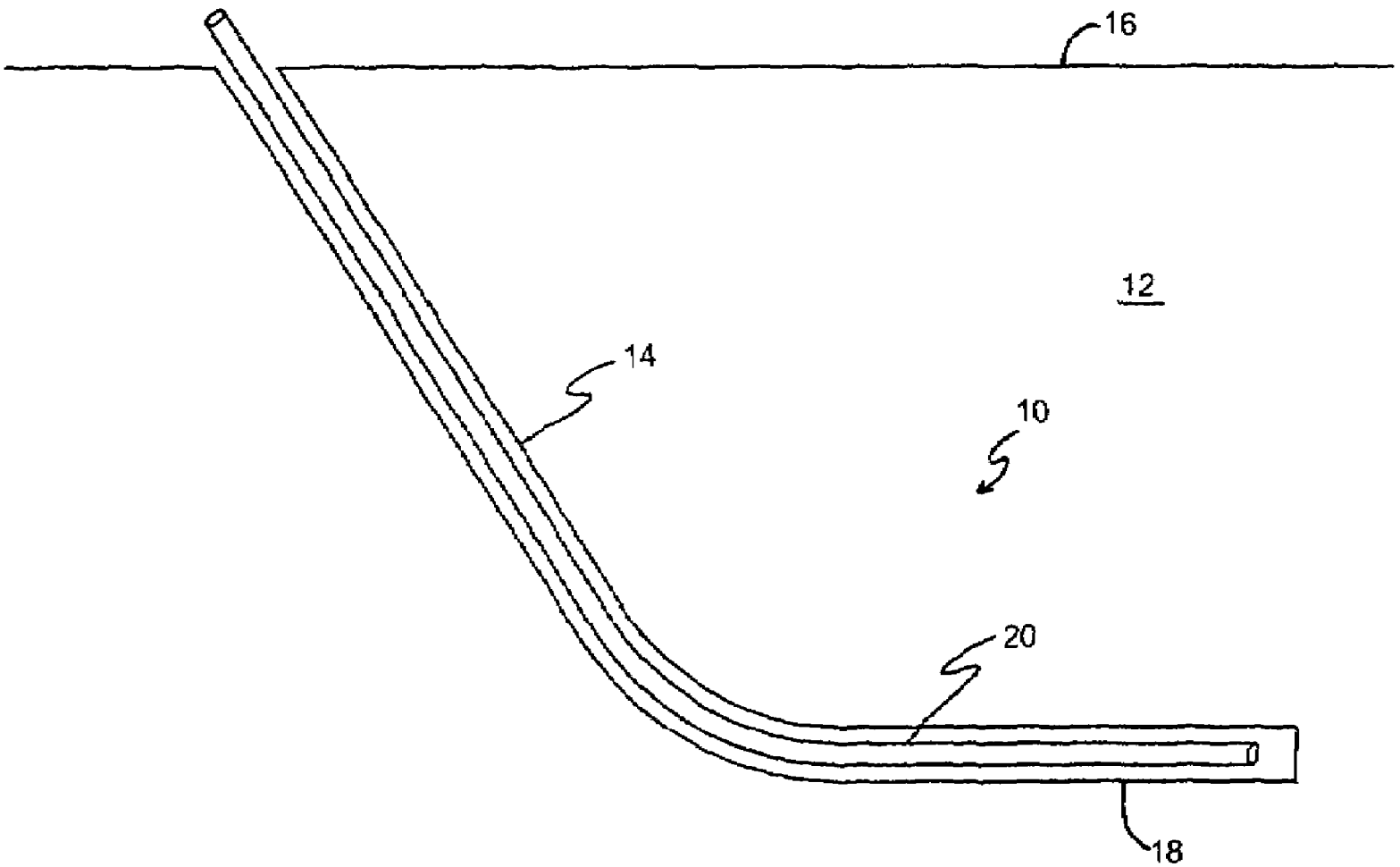
FIG. 1 is a schematic cross-section of a pilot bore for a cryogenic horizontal bore in accordance with the present invention.

A first horizontal cryogenic drilling method is disclosed with reference to FIGS. 1–7. FIG. 1 illustrates a pilot horizontal bore 10 within an earth formation 12. The pilot bore 10 includes a transverse portion 14 transverse to a ground surface 16 and a horizontal portion 18 substantially parallel to the ground surface 16, each having a first diameter D1. The pilot bore 10 may be formed either through the use of a horizontal directional drill using a cryogenic fluid or by conventional drilling muds. Following formation of the horizontal pilot bore 10, a grindable casing or freeze pipe 20 is inserted into the pilot bore.

The grindable casing or freeze tube may be made of any material having sufficient structural integrity to be axially inserted into pilot bore, sufficient structural integrity at cryogenic temperatures to reliably flow cryogenic fluid to the pilot bore and yet be soft enough to be drilled up with conventional drilling equipment. A plastic casing such as one made of high density polyethylene (HDPE) or other suitable plastics may be preferred. For blind bore construction, the grindable casing may consist of an outer pipe and an inner pipe having an annular space between the two pipes to conduct the cryogenic fluid to or from the drill bit. For continuous well construction, the grindable casing may consist of a single pipe.

Figure 2:
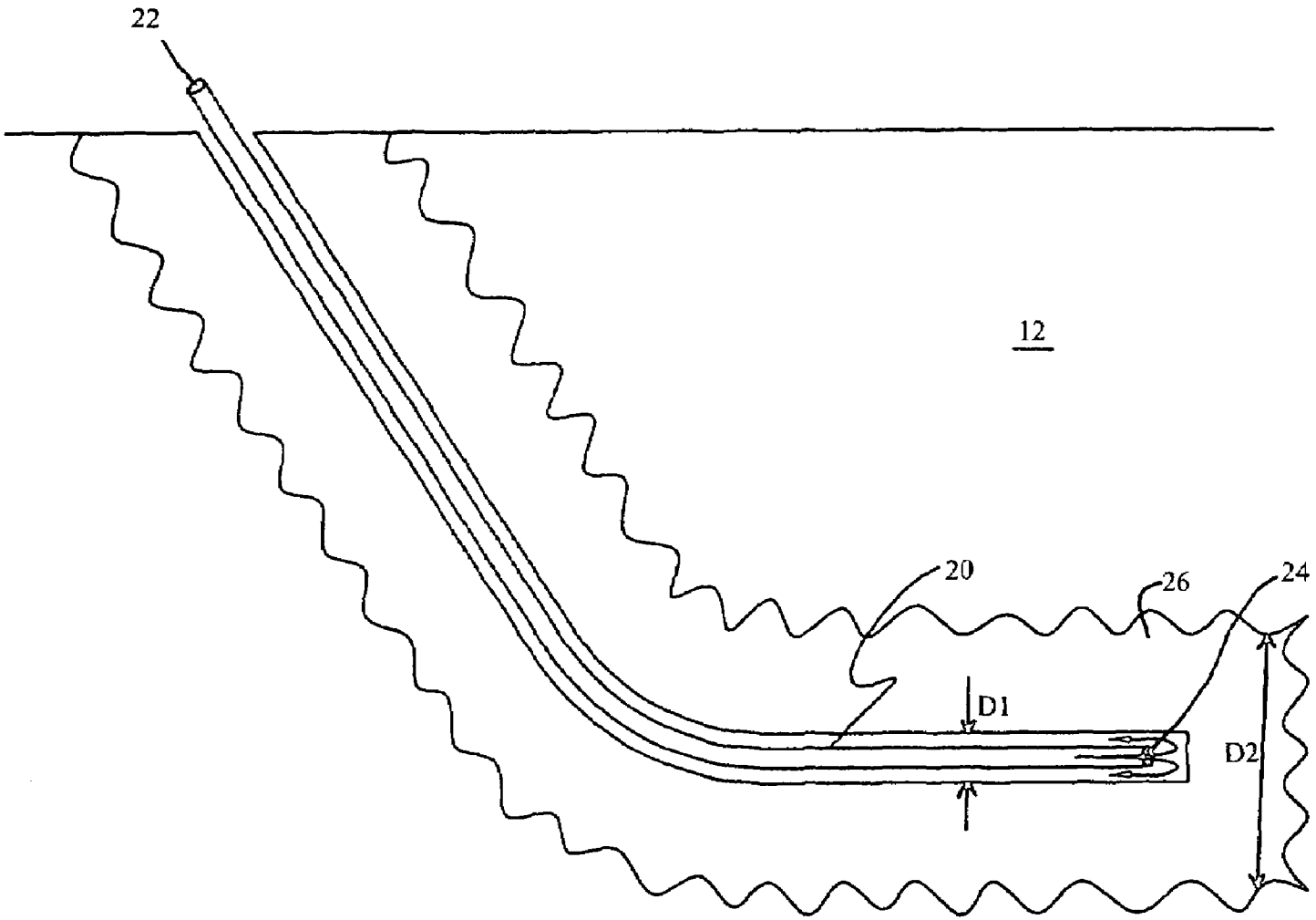
FIG. 2 is a schematic cross-section of a pilot bore of FIG. 1 illustrating a freeze zone formed around the pilot bore.

Referring next to FIG. 2, a cryogenic fluid is injected into the mouth 22 of an inner pipe of grindable casing 20 and the cryogenic fluid flows through the inner pipe, through the annular space between the inner pipe and an outer pipe and out a mouth of the pilot bore 14. The cryogenic fluid could be directed to flow down the outer annulus and return up the inner pipe as a variation of this method. For a continuous bore, the cryogenic fluid flows through the grindable casing 20 from one side of the bore to the other. Two piece freeze pipes may be used for continuous bore construction as a variation of the method. The cryogenic fluid forms a freeze zone 26 having a second diameter D2 in the vicinity of the grindable casing 20.

Figure 3:
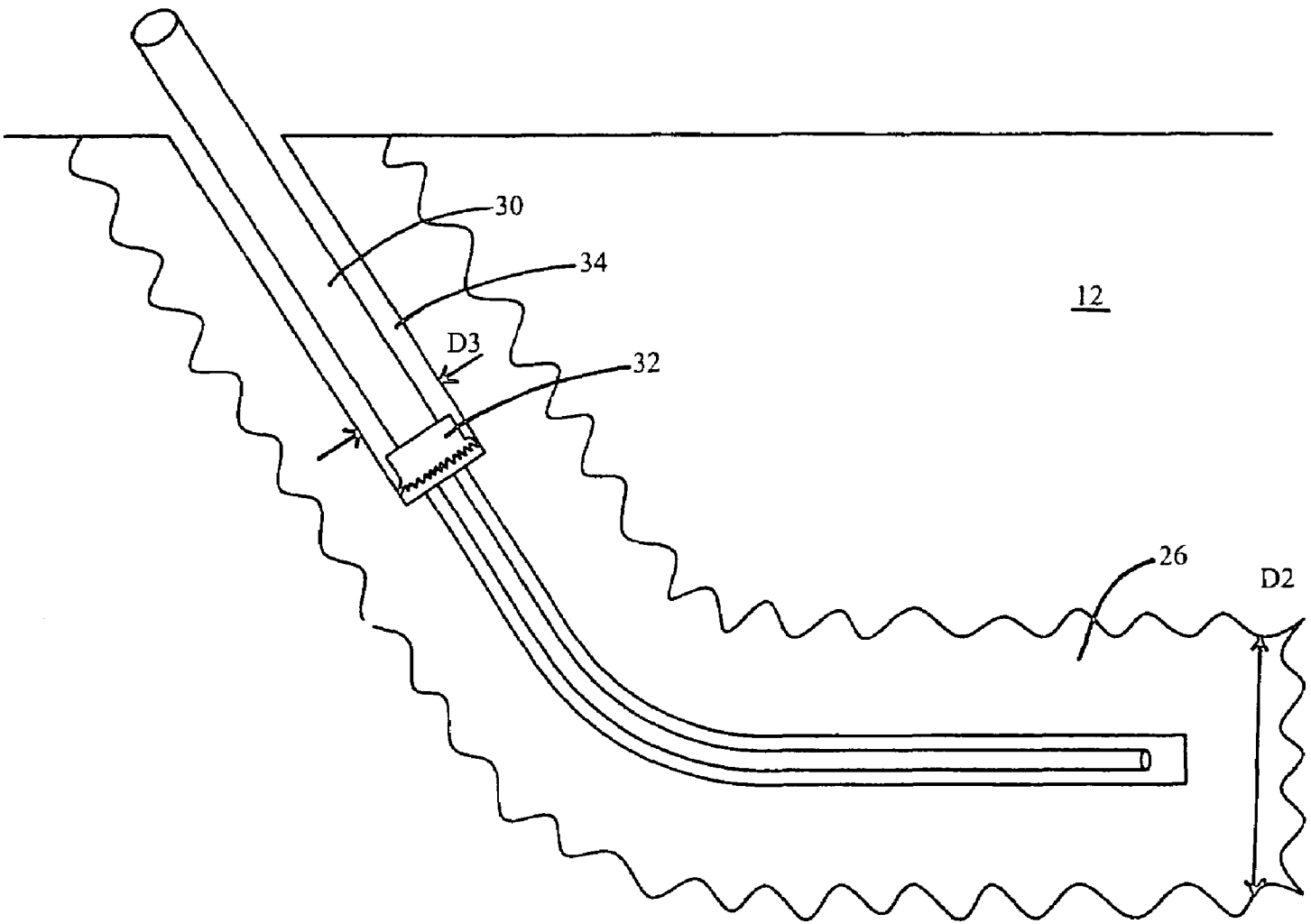
FIG. 3 is a schematic cross-section illustrating a horizontal directional drill reaming the pilot bore of FIG. 2.

Referring to FIG. 3, after formation of a freeze zone of a select diameter D2, a horizontal direction drill string 30 having a cutting tool 32 sized to form a primary bore 34 of a third select diameter D3 reams the primary bore 34 with the grindable casing left in place. The diameter D2 of the freeze zone 26 is selected to be sufficiently greater than the diameter D3 of the primary bore 34 that collapse of the primary bore 34 is prevented. In addition, the freeze zone 26 is of sufficient diameter to withstand forces applied to the earth formation as the primary bore 34 transitions from a transverse portion to a horizontal portion without collapse of the primary bore or formation of a key seat large enough to trap the cutting tool 32. In this manner, the need to install support casings in this transition zone is eliminated.

In the embodiment illustrated in FIGS. 1–3, the horizontal directional drill string may either use cryogenic fluids in place of drilling mud or conventional drilling mud for the pilot bore. Use of cryogenic fluids is preferred so as to maintain the integrity of the freeze zone during the second boring operation and to minimize the introduction of contaminates into the vicinity of the bore.

Figure 4:
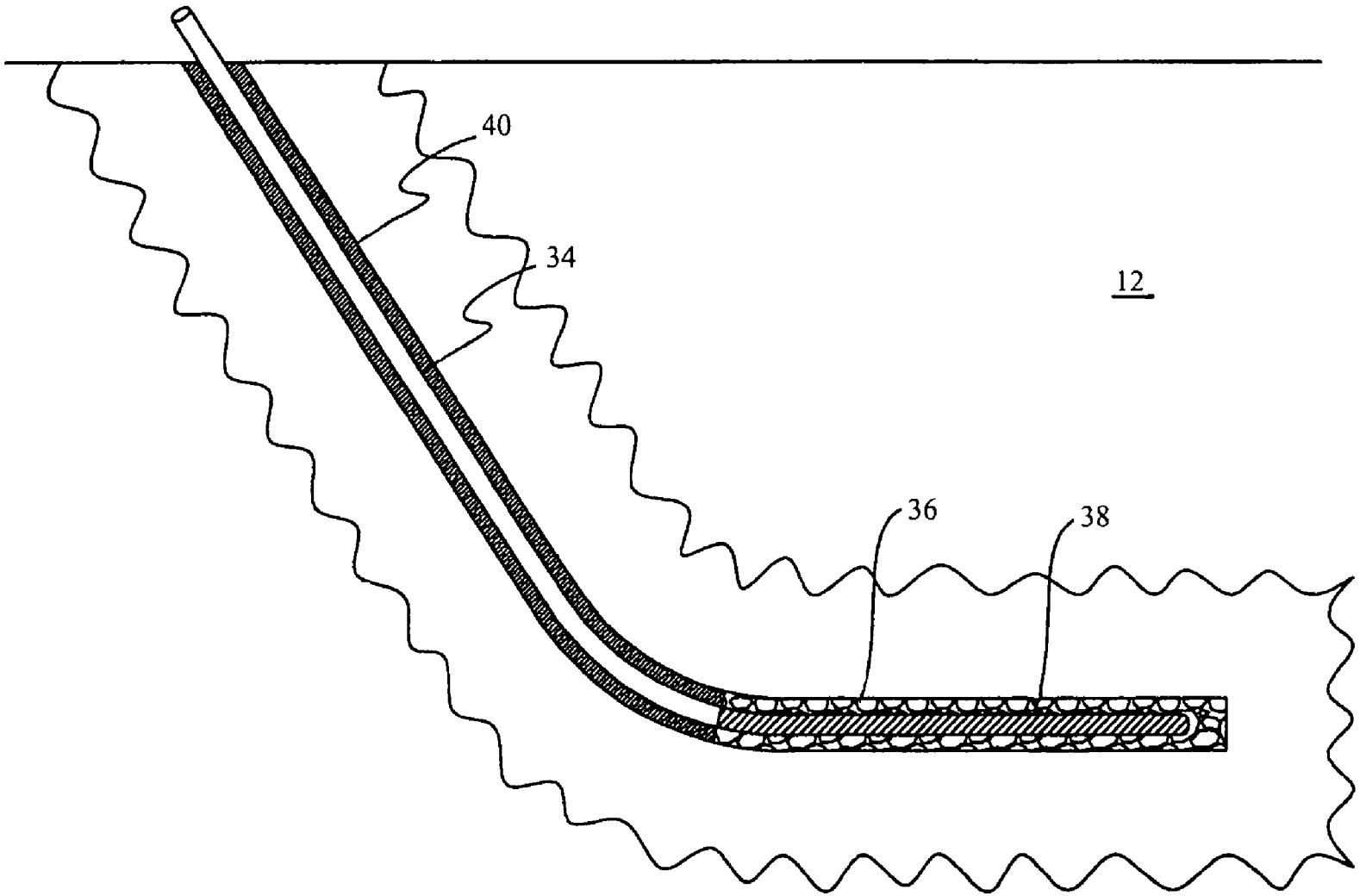
FIG. 4 is a schematic cross-section of a horizontal well including a gravel pack and screen in a horizontal portion and a casing, grouted or ungrouted, between the ground surface and the gravel pack and screen.
Figure 5:
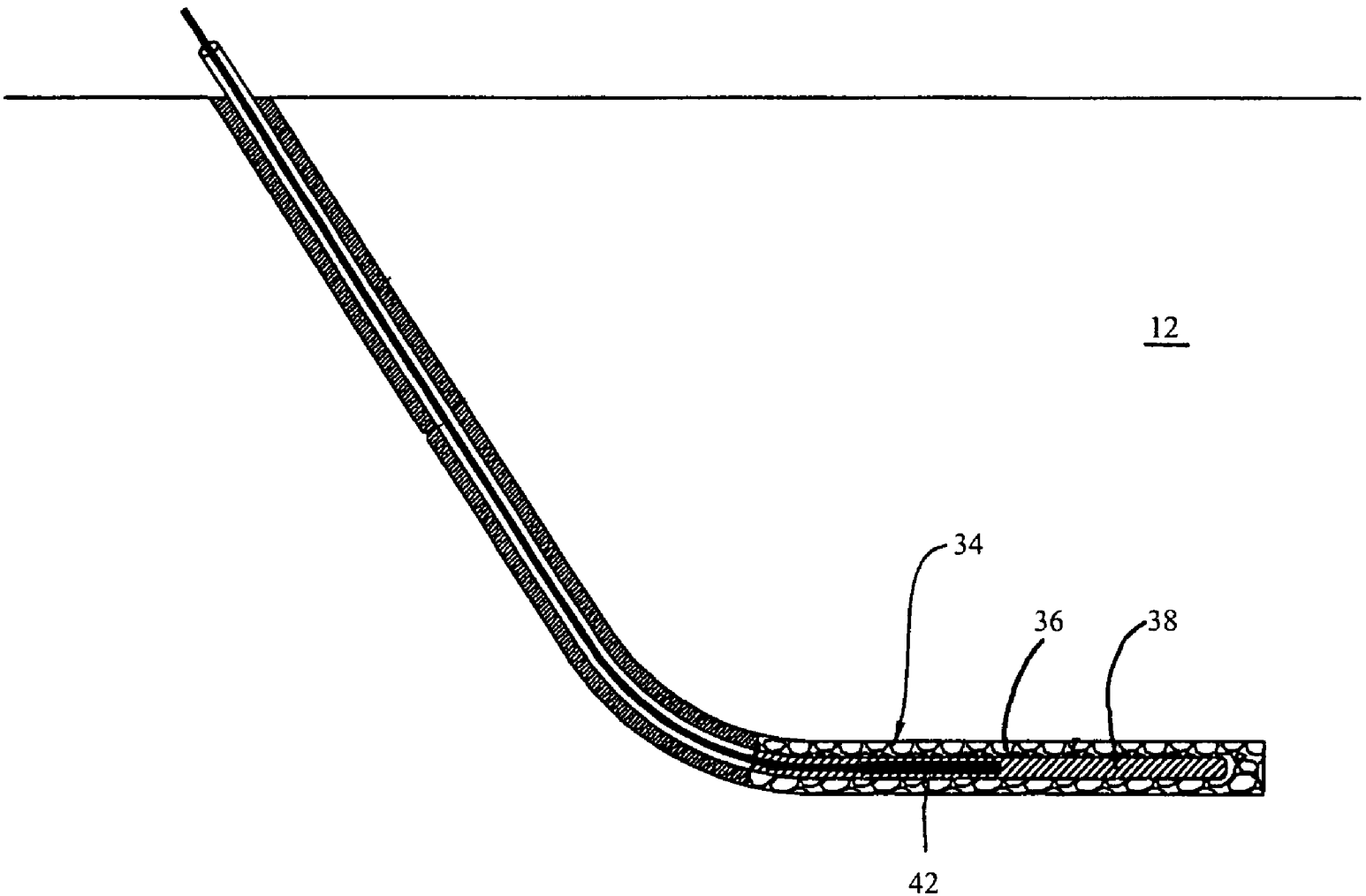
FIG. 5 is a schematic cross-section of FIG. 4 including a submersible pump in a horizontal portion of the well.

Referring to FIG. 4, following completion of the primary bore 34, a gravel pack 36 and screen 38 are preferably installed in the horizontal portion of the primary bore to facilitate flow of water into the primary bore, particularly where the primary bore is to be used as a well. Screens or slotted casings may be used with or without gravel packs. In addition, a casing 40 is installed in the well bore between the ground surface and the gravel pack and screen. The casing may be grouted or ungrouted. The gravel pack and screen and casing are preferably installed before thawing of the freeze zone to maintain the structural integrity of the bore during construction. As illustrated in FIG. 5, for a water supply well a submersible pump 42 can be installed in the horizontal portion of the bore, preferably using a spacer to keep the pump off the screen or casing. Alternatively, the submersible pump may be installed in the transverse portion of the well bore.

Figure 6:
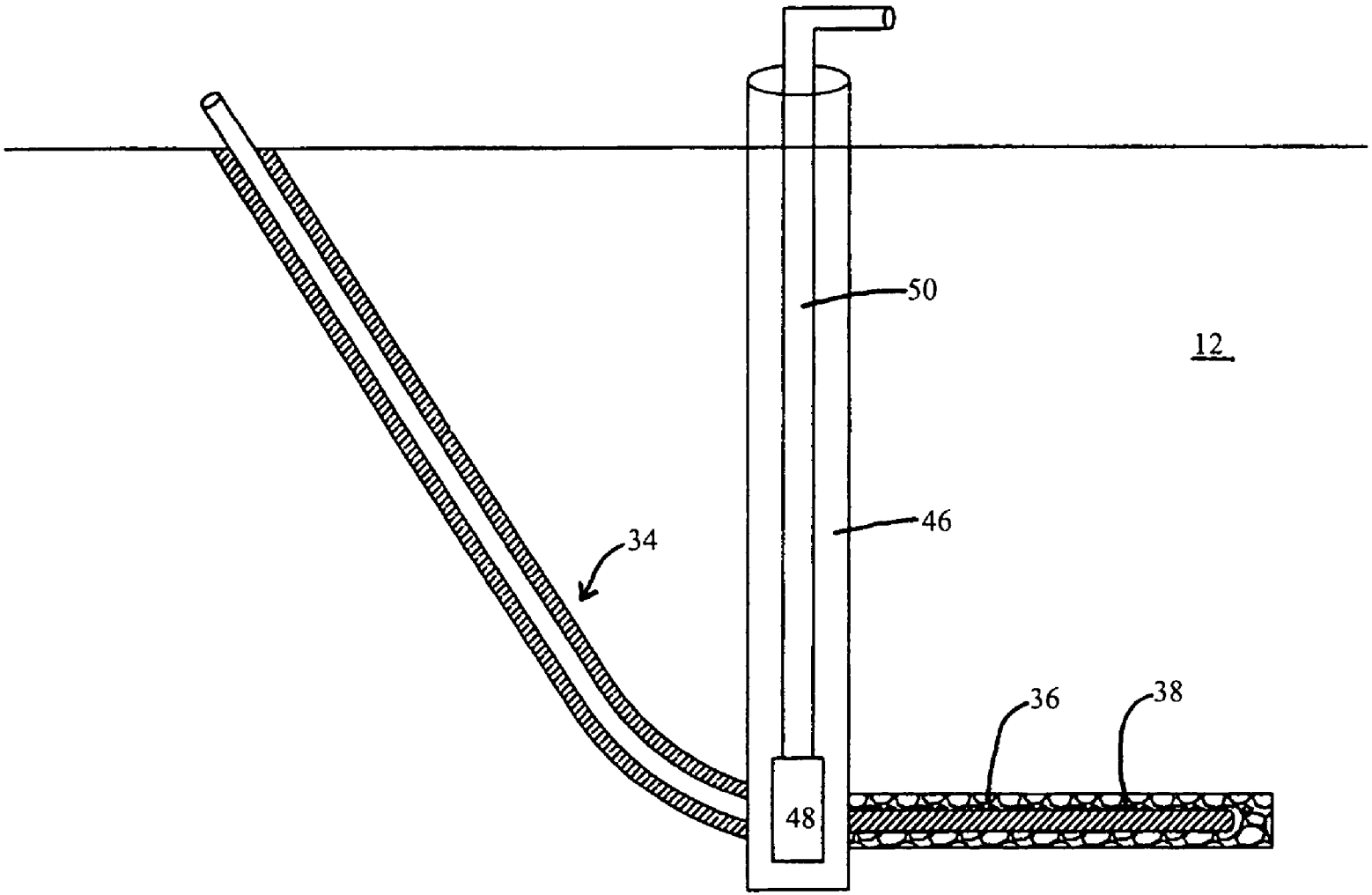
FIG. 6 is a schematic cross-section of the horizontal well of FIG. 4 including a vertical shaft including a submersible pump in communication with the horizontal well.

In an alternative design illustrated in FIG. 6, a vertical interceptor well 46 is installed between the ground surface and the horizontal portion of the bore. A pump 48 is provided in the proximity of the intersection between the vertical interceptor well 46 and the horizontal portion of the well bore at sufficient depth below the water column in the interceptor well 46 and a pipe 50 extends between the pump 48 and the ground surface for the extraction of water from the horizontal bore.

Figure 7:
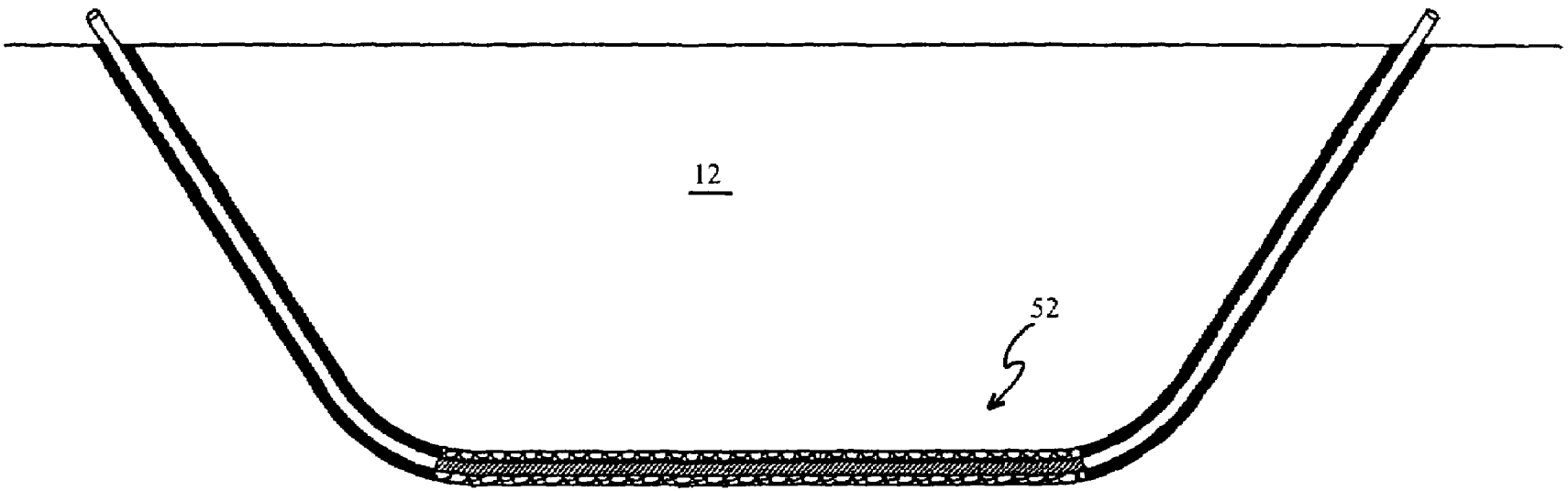
FIG. 7 is a schematic cross-section of a completed continuous bore made in accordance with the horizontal bore cryogenic drilling method of the present invention.

While FIGS. 1–6 are directed to a blind bore construction, FIG. 7 illustrates that the method may be used to construct a continuous bore configuration 52. For a continuous bore, a single piece freeze pipe may be used to pass cryogenic fluids through the bore.

Another aspect of the present invention is a single pass horizontal bore cryogenic drilling method. This method can be illustrated with reference to FIG. 8. A drill string 60 having a conduit in communication with a cutting tool or drill head 62 is provided. The cutting tool 62 is intended for engaging and cutting through an earth formation. The cutting tool 62 may be a rotary drill bit, drilling motor, or a hammer bit modified as discussed above for use with a cryogenic fluid. A cryogenic fluid is flowed through the conduit and the cutting tool and performs several functions. The cryogenic fluid first drives the cutting tool and then functions to remove cuttings from a bore formed by the cutting tool. As an alternate manifestation of the method, the drill rod may be rotated to provide power to the cutting tool or drill bit. The cryogenic fluid further forms a temporary freeze wall 64 in advance of the cutting tool 62.

Figure 8:
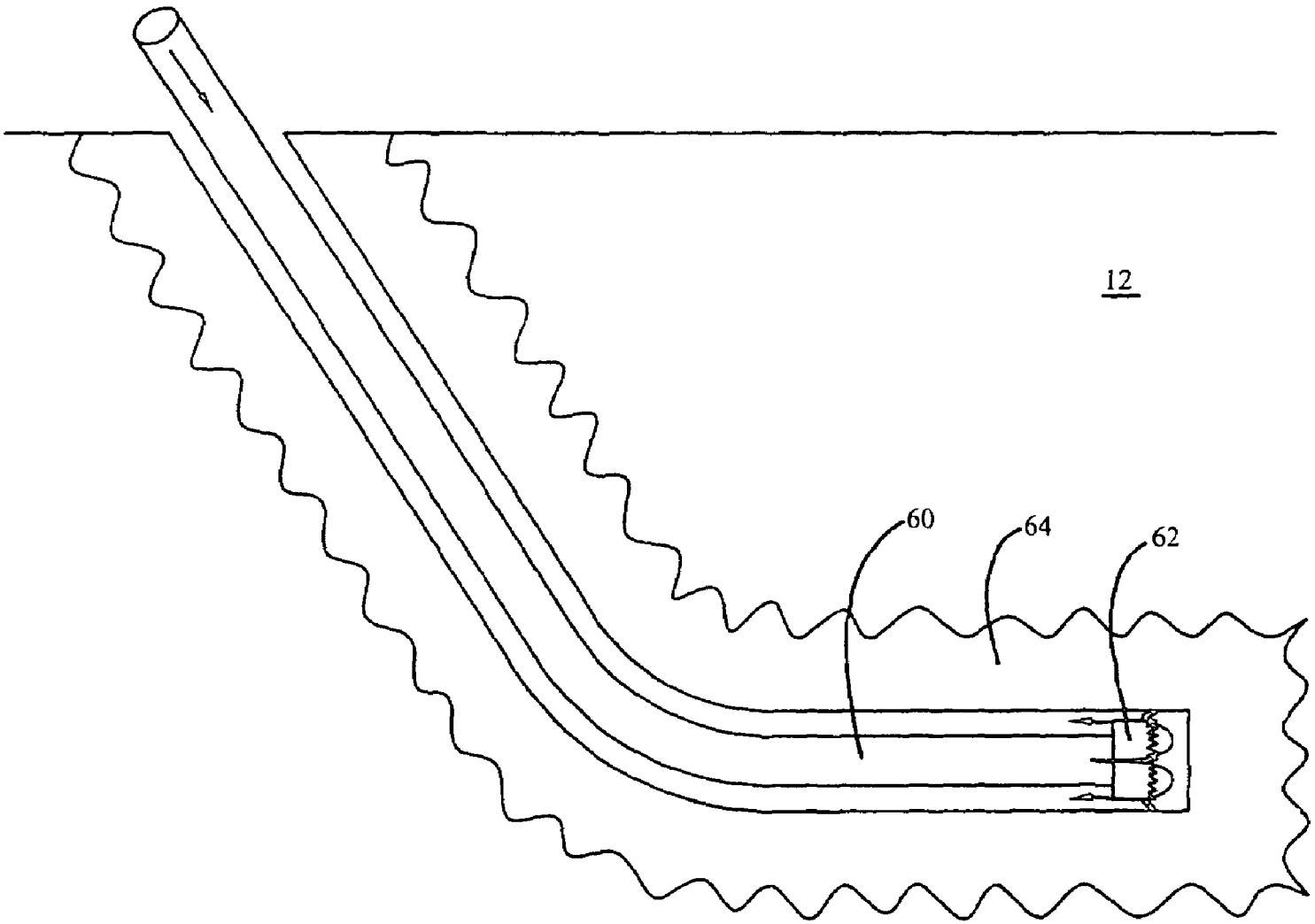
FIG. 8 is a horizontal cross-section of a bore illustrating a second embodiment of a horizontal bore cryogenic drilling method in accordance with the present invention.

In constructing the horizontal bore, the cutting tool is directed into an earth formation and the cryogenic fluid begins forming the freeze zone. A freeze zone of sufficient structural integrity to prevent collapse of the bore is formed. The cutting tool is then advanced along a select path into the earth formation to form the bore at a rate which enables continued formation of the freeze zone in advance of the cutting tool as illustrated in FIG. 8. As with the two pass technique described above, the single pass cryogenic drilling method may be used to either to form a blind bore as illustrated in FIG. 8 or a continuous bore of the type illustrated in FIG. 7. Following completion of the drilling of the bore, a well can be completed by adding the screen, gravel pack and screen and grouted or ungrouted casing as illustrated in FIG. 4. In addition, the submersible pump 42 illustrated in FIG. 5 or the vertical interceptor well 46 illustrated in FIG. 6 may be provided to complete formation of the well.

The horizontal bore cryogenic drilling methods described above allow for expedient and economic drilling of water supply wells where horizontal wells are of particular advantage. The cryogenic techniques eliminate the need for drilling muds which cannot only contaminate water formations, but lead to plugging of the well bore/earth formation interface wall and thus inhibiting of efficient operation of the horizontal well. The freeze wall formed during the cryogenic horizontal well drilling method prevents collapse of the drilling hole during drilling and further allows for installation of gravel packs, screens and casings without collapse of the bore hole. These many advantages can be provided by relatively simple modifications of preexisting directional horizontal drilling equipment.

While the particular embodiments herein are primarily described for use in forming horizontal water supply wells, the methods may also be employed in any application where preventing invasion of drilling muds into earth formations is desired. For example, in the construction of environmental horizontal wells for remediation or construction of groundwater basin recharge wells, geotechnical borings, dewatering wells, borings above the zone of saturation, or injection wells of various types. This invention specifically contemplates horizontal to sub-horizontal borings used to install instrumentation and equipment for a variety of geotechnical purposes, to temporarily stabilize ground for a variety of purposes, or to collect samples of soil or in-situ formation fluids in a stabilized solid form.

What is claimed is:

1. A method of forming a horizontal bore in an earth formation comprising:

a) forming a pilot bore of a first select diameter along a desired path of a horizontal bore;

b) inserting a grindable casing into the pilot bore;

c) flowing a cryogenic fluid through the grindable casing to form a freeze zone of frozen moisture adjacent to the grindable casing having a second select diameter; and d) forming a primary bore having a third select diameter greater than the first select diameter and less than the second select diameter within the freeze zone along the desired path of the horizontal bore with the grindable casing in place, the second select diameter being sufficiently greater than the third select diameter to prevent collapse of the primary bore.

2. The method of claim 1 wherein step a) is performed using a directionally controlled drill string driven by a cryogenic fluid.

3. The method of claim 1 further comprising:

e) installing a screen or gravel pack and screen within a portion of the primary bore while the freeze zone remains sufficiently frozen to prevent collapse of the portion of the primary bore.

4. The method of claim 1 wherein steps a)–d) are performed from a ground surface overlying the earth formation and the horizontal bore includes a transverse portion transverse to the ground surface and a substantially horizontal portion substantially parallel to the ground surface.

5. The method of claim 4 further comprising:

e) installing a screen or gravel pack and screen in the substantially horizontal portion of the primary bore while the freeze zone remains sufficiently frozen to prevent collapse of the primary bore.

6. The method of claim 5 further comprising:

f) installing a casing between the ground surface and the screen.

7. The method of claim 6 further comprising:

g) installing a submersible pump in one of the transverse portion or the substantially horizontal portion.

8. The method of claim 5 further comprising:

f) providing a vertical shaft between the ground surface and the substantially horizontal portion of the primary bore; and g) providing a pump proximate an intersection between the vertical shaft and the substantially horizontal portion of the primary bore.

9. The method of claim 4 wherein in step c) the second select diameter defines a freeze zone of sufficient structural integrity to withstand mechanical forces of a directional drill string used in step d) as the primary bore transitions from the transverse portion to the substantially horizontal portion without collapse of the primary bore.

10. The method of claim 1 further comprising:

e. installing geotechnical instrumentation in the primary bore.

11. The method of claim 1 further comprising:

e. collecting soil or stabilized fluid samples in solid form from the earth formation.

12. A method of forming a horizontal bore in an earth formation comprising:

a) providing a drill string having a conduit communicating with a cutting tool for engaging the earth formation;

b) flowing a cryogenic fluid through the conduit and the cutting tool to drive the cutting tool and remove cuttings from a bore formed by the cutting tool;

c) directing the cutting tool into an earth formation at a ground surface above the earth formation;

d) forming a freeze zone in the earth formation in advance of the cutting tool with the cryogenic fluid flowing through the cutting tool;

e) advancing the cutting tool into the earth formation to form the bore at a rate enabling continuous formation of a freeze zone in advance of the cutting tool; and f) forming a transverse portion of the horizontal bore transverse to the ground surface and a substantially horizontal portion of the horizontal bore substantially parallel to the ground surface, the freeze zone having sufficient structural integrity to withstand mechanical forces of the drill string as the bore transitions from the transverse portion to the substantially horizontal portion without collapse of the bore.

13. The method of claim 12 further comprising installing a screen or gravel pack and screen within the substantially horizontal portion of the bore while the freeze zone remains sufficiently frozen to prevent collapse of the substantially horizontal portion of the bore.

14. The method of claim 13 further comprising installing a submersible pump in either the transverse portion or the substantially horizontal portion of the bore.

15. The method of claim 13 further comprising providing a vertical shaft between the ground surface and the substantially horizontal portion of the bore and providing a pump proximate an intersection between the vertical shaft and the substantially horizontal portion of the bore.

16. The method of claim 13 further comprising:

f) installing casing between the ground surface and the screen.

* * * * *